United States Patent [19]

Richardson et al.

[11] Patent Number: 4,967,876

[45] Date of Patent: Nov. 6, 1990

[54] POWERED ACCESS PLATFORM UNITS

[76] Inventors: Mark J. Richardson, 61 Longfields, Swaffham, Norfolk; Colin Marshall, 15 Beatty Close, Thetford, Norfolk, both of England

[21] Appl. No.: 345,426

[22] Filed: May 1, 1989

[30] Foreign Application Priority Data

May 11, 1988 [GB] United Kingdom ..... 8811111

[51] Int. Cl.[5] ..... B66F 11/04

[52] U.S. Cl. ..... 182/148; 182/63

[58] Field of Search ..... 182/148, 63, 2

[56] References Cited

U.S. PATENT DOCUMENTS

| | | | |
|---|---|---|---|
| 3,043,395 | 7/1962 | Volkel | 182/2 |
| 3,332,513 | 7/1967 | Wiebe | 182/63 X |
| 3,584,705 | 6/1971 | Ruegg | 182/2 X |
| 3,768,591 | 10/1973 | Stucky et al. | 182/2 |
| 4,511,015 | 4/1985 | Purdy | 182/2 |

FOREIGN PATENT DOCUMENTS

| | | | |
|---|---|---|---|
| 1452054 | 8/1966 | France | 182/2 |
| 1431980 | 4/1976 | United Kingdom | 182/2 |
| 2201138 | 8/1988 | United Kingdom | 182/2 |

*Primary Examiner*—Karen J. Chotkowski

*Attorney, Agent, or Firm*—Edwin D. Schindler

[57] ABSTRACT

A powered access platform unit having a wheeled base carrying a corner pillar to which is articulated one end of a parallel linkage boom articulated at the other end to the remote corner of a platform structure on the same side of said structure as the side of the base which carries the corner pillar, and a drive unit on the base for raising and lowering the platform structure on the parallel linkage boom by means of an hydraulic ram articulated between the base pillar and the boom.

9 Claims, 2 Drawing Sheets

POWERED ACCESS PLATFORM UNITS

FIELD OF THE INVENTION

This invention relates to a platform having a powered drive for lifting the user and equipment and/or materials from a first level to a higher level in order to give working access to an elevated part of a building or other structure. Such a platform is referred to herein as a powered access platform unit.

BACKGROUND OF THE INVENTION

A powered access platform unit comprises a base, an elevating structure, a platform mounted on the elevating structure, and a power unit for raising or lowering the platform via the elevating structure.

It is a general object of this invention to provide a powered access platform unit which, in a preferred version, is especially suitable for domestic use, although not limited to this application. For domestic use, e.g. to enable the user to have easy access to the upper parts of a house for the purpose of roof repairs, painting or the like, it is important for the platform unit to be easy and safe to use, to collapse to a relatively small size to enable it to pass through house gateways and doorways, to be easily manoeuvrable and, in the collapsed condition, to locate the platform close to ground level to facilitate easy entry. Generally, however, it is not to be expected that the platform will have to raise very substantial loads to substantial heights, as is the case with many powered access platforms intended for industrial use. At the same time, it will be understood that, whilst retaining the advantages of ease of use, maneuverability and platform entry, it is readily possible to manufacture the unit of this invention to a size and scale which makes it suitable for industrial use.

BRIEF SUMMARY OF THE INVENTION

According to the invention, a powered access platform unit comprises a base maneuverable on ground wheels, a platform structure comprising a platform having a skeleton safety wall, an elevating means in the form of a parallel linkage boom articulated between the upper end of a pillar on one side of the base and the corresponding side of the platform structure, and a power drive unit controllable from the platform for raising and lowering the platform structure via the parallel linkage boom.

Most preferably, in its fully lowered condition, the platform structure is accommodated substantially wholly within the length, width and height of the base and boom-supporting pillar. In order to achieve this, the pillar is preferably provided at one end of the said side of the base, i.e. at a corner thereof, and the parallel boom linkage preferably connects with the platform structure at the end of the said corresponding side thereof remote from the pillar, so that in its fully lowered condition the platform structure extends lengthwise from its remote end over the base and towards the pillar. This means, in practice, that the parallel linkage boom connects to the platform structure at a remote corner thereof, on the same side of the platform as the side of the base at which the pillar is provided at the corner.

The parallel linkage boom conveniently comprises a pivotted boom member drivable by the drive unit, and a tie rail pivotally mounted in parallel with the boom member. The parallel linkage boom maintains a horizontal attitude of the platform throughout its range of elevation.

In one arrangement, the boom connects between the top of the base pillar and a fixed post forming part of the platform structure. In this way, the simple elevating structure is able to provide for elevation of the platform to an adequate level appropriate to the intended use of the platform whilst lowering the platform structure, to one side of the collapsed boom, to a level sufficiently close to the ground to enable it to be easily entered. Thus, the platform structure post may depend for a short distance below the platform, so that the parallel boom linkage connections are below the platform, thus increasing the maximum height of elevation of the platform. Alternatively, the platform may be substantially at the bottom of the post, so that the parallel boom linkage connections are above the platform, thus reducing to a minimum the level of the fully lowered platform above the ground. A platform access level as low as 25 cm (10 inches) above the ground is achievable, if desired.

In the preferred arrangement, the base has a single pair of wheels, one on each side, conveniently approximately at the center of the length, of the platform unit, so that the said unit can be maneuvered, in analogous manner to a wheel barrow.

At least the platform structure, but possibly also parts of the base and elevating structure, may be fabricated of a toughened plastics material. One practical drive unit is a reversible electric motor and associated hydraulic pump on-board the base, together with an hydraulic ram drivable by the motor driven pump, the ram being articulated between the base or pillar thereon and the parallel linkage boom, i.e. the boom member thereof. This motor may be adapted to be driven from the mains supply through a length of flexible cable.

Control of the motor for raising and lowering the platform is preferably by means of a control means on the platform structure, a connecting lead between the control means and the motor being routed from the platform structure along the parallel boom linkage and down the base pillar.

An hydraulic or other drive unit sourced from a rechargeable power pack may be employed instead, if preferred. If the drive unit is also employed for propulsion, which is generally to be considered unnecessary in view of the lightness and compactness of the collapsed platform unit, then the propulsion drive will only be controllable from a steering position on the ground.

BRIEF DESCRIPTION OF DRAWINGS

A practical embodiment of powered access platform unit in accordance with the invention is exemplified in the following description, making reference to the accompanying drawings, in which.

DESCRIPTION OF EMBODIMENT

Figure 2:
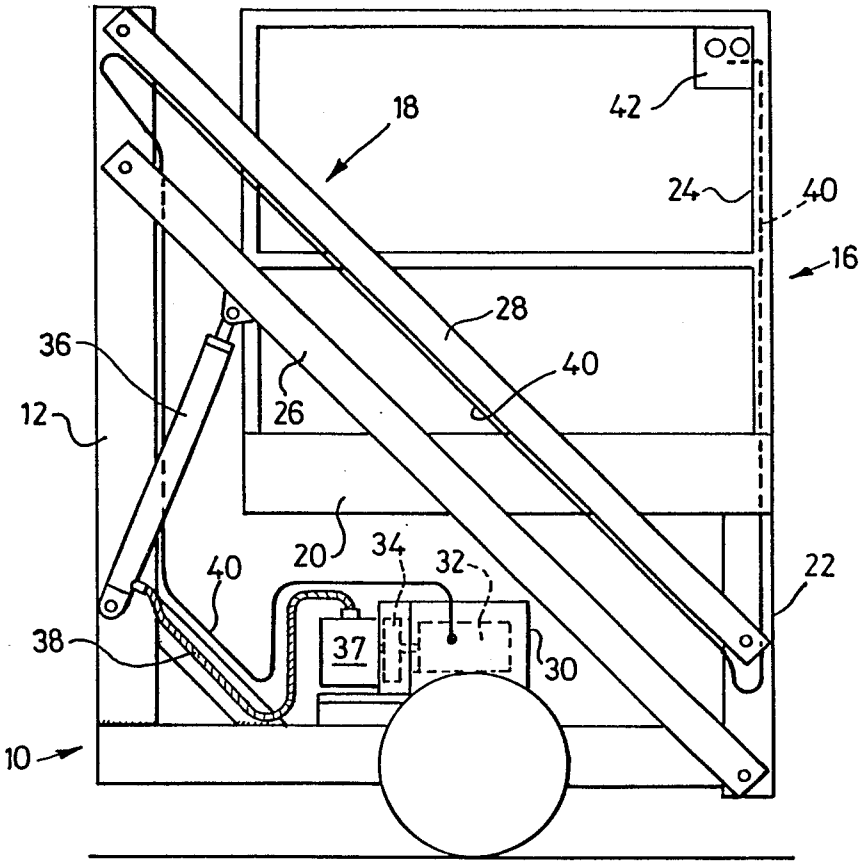
FIG. 2 is a side elevational view with the platform structure in its lowered position on the base.
Figure 1:
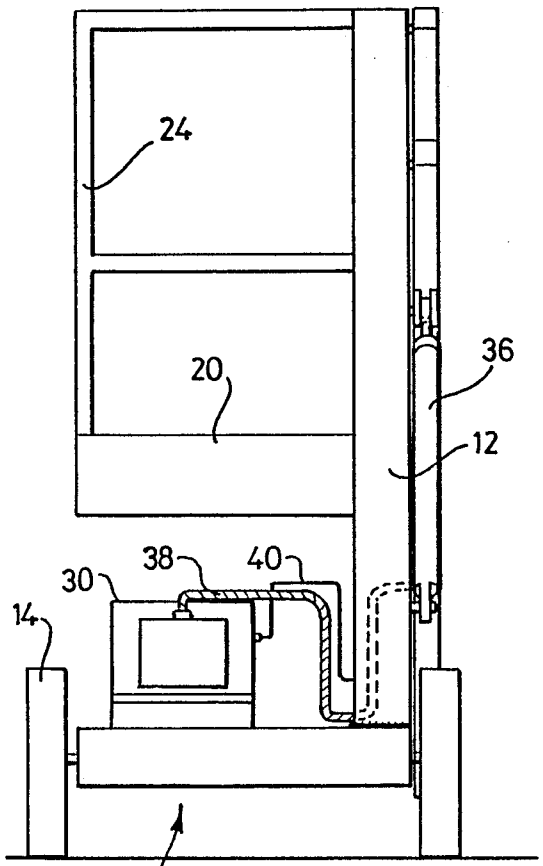
FIG. 1 is an end elevational view of the platform unit.
Figure 2A:
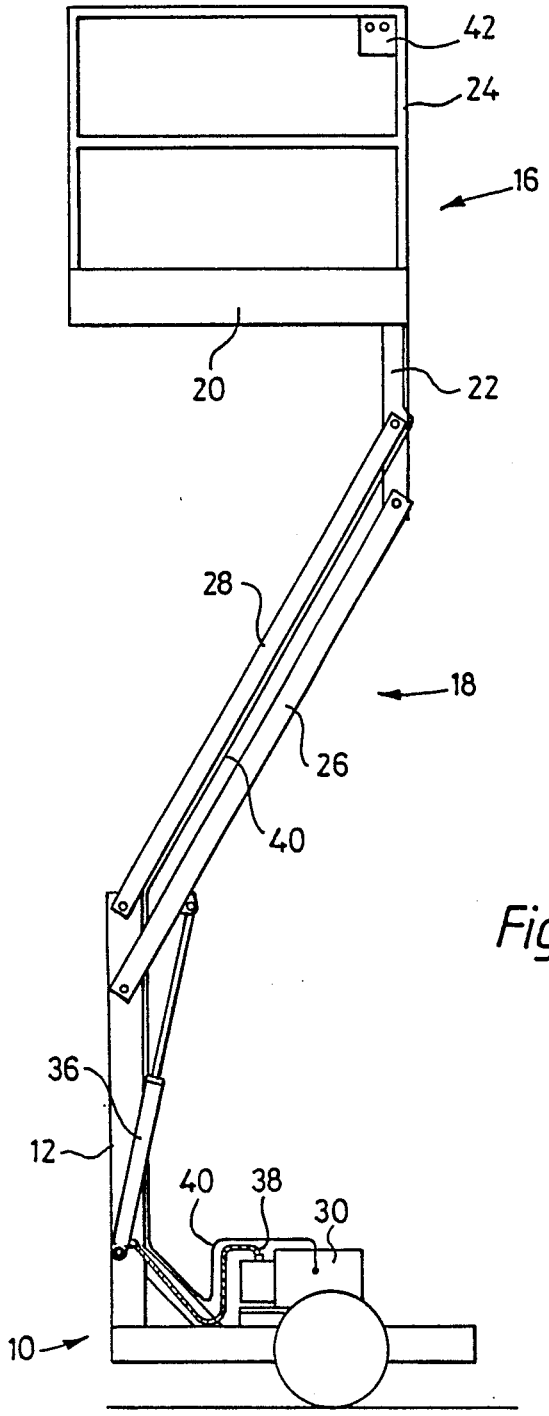
FIG. 2A is a side elevational view with the platform structure elevated relative to the base.

Referring to the drawings, the illustrated platform unit comprises a base generally referenced 10 and which includes an upstanding corner pillar 12. The base has a pair of wheels 14 for enabling maneuvering of the unit in the manner of a wheel barrow. Separable stabilising feet (not shown) are provided to enable the platform unit to be stably anchored in a position of use.

A platform structure generally referenced 16 is supported on the base 10 by an elevating means generally referenced 18. The platform structure 16 includes a platform 20 having a post 22 which depends for a relatively short distance at the corner remote from the pillar 12 on the side of the platform structure corresponding to the side of the base on which said pillar is provided. The platform structure also includes a skeleton wall 24 for the platform 20; this wall 24 is open at one end of the platform or may have end gates (not shown).

The elevating means 18 consists of a parallel link boom pivotally connecting directly between the upper end region of the base pillar 12 and the depending platform post 22, whereby this elevating structure is disposed wholly on one side only of the platform unit. The parallel link boom comprises the boom 26 proper and a parallel tie rail 28. The boom 26 is driven to elevate the platform structure, and the tie rail 28 maintains the horizontal attitude of the platform during movement.

A convenient drive comprises a reversible electric motor 32 driving an hydraulic pump 34 which drives an hydraulic ram 36 articulated between the pillar 12 and the boom 26. Reference 38 denotes the hydraulic connection between the pump and the ram. The motor and pump are accommodated in a housing 30 on-board the base 10. Reference 37 denotes a reservoir of hydraulic fluid for the pump. The elevating drive is operable from the platform by a control means 42. The connecting lead 40 from the control means 42 to the motor 32 is routed via the parallel link boom and the base pillar. It is visualised, that the unit, in its collapsed condition, will be maneuverable by hand, but if a powered drive for the ground wheels is provided, the control for this purpose will be operable only from ground level.

From FIG. 2, it will be noted that the platform structure lowers towards the base by the side of the collapsed elevating structure. In the minimum level position, the top of the skeleton wall is approximately level with the top of the base pillar, and the platform structure in its minimum level position is readily loaded and entered by the user. By mounting the platform level with the bottom of the post 22, its minimum level position can be made as low as 25 cm (10 inches), but with a small loss in maximum elevation. When collapsed, the length and width of the platform unit and its height are such that the unit can readily be maneuvered through domestic gateways and doorways, as the platform structure is wholly accommodated in the space (area x height) defined by the base and base pillar. It is visualised that, for domestic applications, the load capacity of the platform structure will be about 250 kg (500 lbs), and that the platform will elevate to a level of six to eight meters (20 to 25 feet) above the ground. Various modifications of the above-described and illustrated platform unit are possible within the scope of the invention defined by the appended claims.

We claim:

1. A powered access platform, comprising:

a base having a first side extending between a first corner and a second corner of said base;

ground wheels on which said base is capable of being maneuvered;

a pillar upstanding from said base adjacent said first corner on said first side of said base;

a platform structure comprising a floor and a skeleton safety wall, said platform structure having a first side extending between a first corner and a second corner of said platform structure in a corresponding relationship to said first side and said first corner and said second corner of said base;

elevating means for raising and lowering said platform structure relative to said base, said elevating means comprising a parallel linkage boom operative substantially in a vertical plane extending along said first side of said base, said boom being articulated between said pillar adjacent a top of said pillar and said platform structure adjacent and second corner of said platform structure whereby, in a lowered condition of said platform structure, said boom extends in an inclined direction downwardly from said pillar substantially towards said second corner of said base on said first side of said base and said platform structure is disposed above said base in a side-by-side relationship to the boom;

a power drive unit for raising and lowering said platform structure on said parallel linkage boom; and, control means on said platform structure for controlling said power drive unit.

2. A platform unit according to claim 1, wherein the platform structure, when in the lowered condition, is accommodated substantially wholly within the length, width and height of the base and pillar.

3. A platform unit according to claim 1, wherein the parallel linkage from comprises an articulated boom member drivable by the drive unit and a tie rail articulated in parallel with the boom member.

4. A platform unit according to claim 1, wherein the parallel linkage boom connects between the top of the pillar and a point of the platform structure adjacent an undersurface of the platform structure.

5. A platform unit according to claim 1, wherein the platform structure includes a fixed post to which the parallel linkage boom is articulated.

6. A platform unit according to claim 1, wherein the base has a single pair of ground wheels disposed generally centrally of the length of said base.

7. A platform unit according to claim 1, having a platform structure of toughened plastics material.

8. A platform unit according to claim 1, wherein the drive unit is mounted on the base and comprises a reversible electric motor, an hydraulic pump drivable by the motor, and an hydraulic ram operable by the pump and connecting between the pillar and the parallel linkage boom.

9. A platform unit according to claim 8, wherein a connecting lead from the control means on the platform structure to the motor on the base is routed via the parallel linkage boom and the pillar.

* * * * *